US011841147B2

(12) United States Patent
Deokar

(10) Patent No.: US 11,841,147 B2
(45) Date of Patent: Dec. 12, 2023

(54) HEAT RECOVERY APPARATUS AND METHODS OF INCREASING ENERGY EFFICIENCY OF HYBRID HEATING SYSTEMS USING THE APPARATUS

(71) Applicant: Rheem Manufacturing Company, Atlanta, GA (US)

(72) Inventor: Pratik S. Deokar, Lewisville, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 102 days.

(21) Appl. No.: 17/515,718

(22) Filed: Nov. 1, 2021

(65) Prior Publication Data

US 2023/0134566 A1 May 4, 2023

(51) Int. Cl.
*F24D 11/02* (2006.01)

(52) U.S. Cl.
CPC ..... *F24D 11/0285* (2013.01); *F24D 11/0271* (2013.01); *F24D 2200/04* (2013.01); *F24D 2200/123* (2013.01); *F24D 2200/18* (2013.01)

(58) Field of Classification Search
CPC ..... F24D 11/0285; F24D 11/0271; F24D 2200/04; F24D 2200/123; F24D 2200/18
See application file for complete search history.

(56) References Cited

U.S. PATENT DOCUMENTS 4,491,093 A * 1/1985 Hoekstra ..... F22B 3/045 122/451 S
2013/0328322 A1* 12/2013 Julian ..... F24D 18/00 110/235

FOREIGN PATENT DOCUMENTS

JP 2009222242 A * 10/2009
SU 1714313 A1 * 2/1992

* cited by examiner

*Primary Examiner* — Emmanuel E Duke
(74) *Attorney, Agent, or Firm* — Eversheds Sutherland (US) LLP

(57) ABSTRACT

A hybrid heating system having a heat recovery apparatus in fluid communication with a heat pump and a furnace is provided. The apparatus recovers heat from flue gas discharged from the furnace and transfers the recovered heat to a stream of refrigerant in the heat pump. The apparatus includes a shell disposed in fluid communication with the furnace and tubes disposed in fluid communication with the shell and the heat pump. The system includes valves for regulating access between the apparatus and the stream of the refrigerant in the heat pump, and a control unit in communication with the valves to regulate access between the apparatus and the heat pump during a heating mode based on operating parameters of the system.

18 Claims, 6 Drawing Sheets

HEAT RECOVERY APPARATUS AND METHODS OF INCREASING ENERGY EFFICIENCY OF HYBRID HEATING SYSTEMS USING THE APPARATUS

TECHNICAL FIELD

The present disclosure relates, in general, to hybrid heating systems, and more specifically relates to a heat recovery apparatus and methods of increasing energy efficiency of the hybrid heating systems using the apparatus.

BACKGROUND

Air conditioning systems are generally used for conditioning air within a closed space. Such air conditioning systems comes with varying capacity and power rating to heat or cool the air within the closed space based on a size of the closed space. In one example, an air conditioning system may be a heat pump for heating or cooling the closed space. In another example, a heat pump alone may not be able to meet required heating load demanded by the closed space, in such a case, a furnace is combined with the heat pump to meet the required heating load within the closed space. In such hybrid heating arrangement, the heat pump and the furnace operate together to meet the required heating load within the closed space.

The furnace, generally, includes a combustion chamber in which a fuel is burned to provide additional heat energy to the air within the closed space. During operation of the furnace, the combustion chamber discharges flue gas which is generally disposed to atmosphere. The flue gas also carries heat which may be recovered by a heat recovery device for different use. In a known system, the recovered heat is transferred to water, or other secondary fluid(s), which in turn transfer heat to refrigerant in a vapor compression cycle system. Hence, there remains a need to develop a system with a heat recovery apparatus to reuse the heat energy disposed to the atmosphere as waste by directly exchanging it with the refrigerant in a heat pump, thereby to improve performance of the hybrid heating system and overcome the shortcomings of the known heating system.

SUMMARY

According to one aspect of the present disclosure, an apparatus for recovering heat from flue gas discharged from a furnace of a hybrid heating system is disclosed. The apparatus includes a shell disposed in fluid communication with the furnace and configured to allow the flue gas to flow therethrough in a first direction. The shell includes an inlet port fluidly coupled with a flue gas duct of the furnace and configured to receive the flue gas. The shell includes an outlet port configured to exit the flue gas. The flue gas flows from the inlet port to the outlet port in the first direction. The apparatus further includes one or more tubes disposed in fluid contact with the shell and fluidly communicated with a heat pump which is in fluid contact with the furnace of the hybrid heating system. The one or more tubes are configured to allow a stream of refrigerant to flow therethrough in a second direction. The one or more tubes are disposed along a length of the shell and includes an inlet end and an outlet end together configured to fluidly couple with a stream of the refrigerant in the heat pump, and the refrigerant flows from the inlet end to the outlet end in the second direction. The second direction of the flow of the stream of the refrigerant is different from the first direction of the flow of the flue gas.

In one embodiment, the apparatus further includes a container disposed proximate a bottom end of the shell configured to collect condensate therefrom.

In one embodiment, the apparatus further includes an inlet conduit and an outlet conduit configured to fluidly communicate with the inlet end and the outlet end, respectively, of the one or more tubes.

In one embodiment, the apparatus further includes one or more valves disposed in at least one of the inlet conduit and the outlet conduit and configured to regulate access between the apparatus and the heat pump during a heating mode based on one or more operating parameters of the hybrid heating system.

According to another aspect of the present disclosure, a hybrid heating system including a heat pump and a furnace is disclosed. The hybrid heating system includes a heat recovery apparatus in fluid communication with the heat pump and the furnace. The heat recovery apparatus is configured to (i) recover heat from flue gas discharged from the furnace, and (ii) transfer the recovered heat to a stream of refrigerant in the heat pump. The heat recovery apparatus includes a shell disposed in fluid communication with the furnace and configured to allow the flue gas to flow therethrough in a first direction. The heat recovery apparatus further includes one or more tubes disposed in fluid communication with the shell and the heat pump. The one or more tubes are configured to allow a stream of refrigerant to flow therethrough in a second direction. The second direction of the flow of stream of the refrigerant is different from the first direction of the flow of the flue gas. The hybrid heating system further includes one or more valves configured to regulate access between the heat recovery apparatus and the stream of the refrigerant in the heat pump. The hybrid heating system further includes a control unit in communication with the one or more valves and configured to regulate access between the heat recovery apparatus and the heat pump during a heating mode based on one or more operating parameters of the hybrid heating system. The hybrid heating system further includes one or more sensing devices configured to communicate inputs indicative of the one or more operating parameters of the hybrid heating system with the control unit.

The heat recovery apparatus is fluidly coupled with the stream of the refrigerant in series with an evaporator of the heat pump. In one embodiment, the heat recovery apparatus is fluidly coupled with the stream of the refrigerant at a downstream end of the evaporator of the heat pump. In another embodiment, the heat recovery apparatus is fluidly coupled with the stream of the refrigerant at an upstream end of the evaporator of the heat pump. In yet another embodiment, the heat recovery apparatus is fluidly coupled with the stream of the refrigerant in parallel to the evaporator of the heat pump. Particularly, an inlet end and an outlet end of the one or more tubes of the heat recovery apparatus are fluidly coupled with the upstream end and the downstream end, respectively, of the evaporator of the heat pump. The heat recovery apparatus is configured to supply refrigerant to the stream of the refrigerant in the heat pump during a defrosting mode and a heating mode of the hybrid heating system.

According to yet another aspect of the present disclosure, a method of increasing energy efficiency of a hybrid heating system during a heating mode is disclosed. The hybrid heating system includes a heat pump and a furnace. The method includes contacting a heat recovery apparatus with a stream of flue gas discharged from the furnace and a stream of refrigerant in the heat pump. The heat recovery apparatus includes a shell and one or more tubes disposed in contact with the shell. The method further includes directing the flue gas to flow through the shell in a first direction and directing the stream of the refrigerant to flow through the one or more tubes in a second direction. The one or more tubes are fluidly communicated with a stream of the refrigerant in the heat pump. The second direction of the flow of the stream of the refrigerant is different from the first direction of the flow of the flue gas. The method further includes introducing, via the heat recovery apparatus, a stream of refrigerant to the stream of the refrigerant in the heat pump during the heating mode and a defrosting mode. In an embodiment, the method further includes regulating access between the heat recovery apparatus and the heat pump during the heating mode, via a control system and one or more valves, based on one or more operating parameters of the hybrid heating system.

The method further includes fluidly coupling the heat recovery apparatus with the stream of the refrigerant in series with an evaporator of the heat pump. In one embodiment, the method includes fluidly coupling the heat recovery apparatus with the stream of the refrigerant at a downstream end of the evaporator of the heat pump. In another embodiment, the method includes fluidly coupling the heat recovery apparatus with the stream of the refrigerant at an upstream end of the evaporator of the heat pump. In yet another embodiment, the method includes fluidly coupling the heat recovery apparatus with the stream of refrigerant in parallel to the evaporator of the heat pump.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
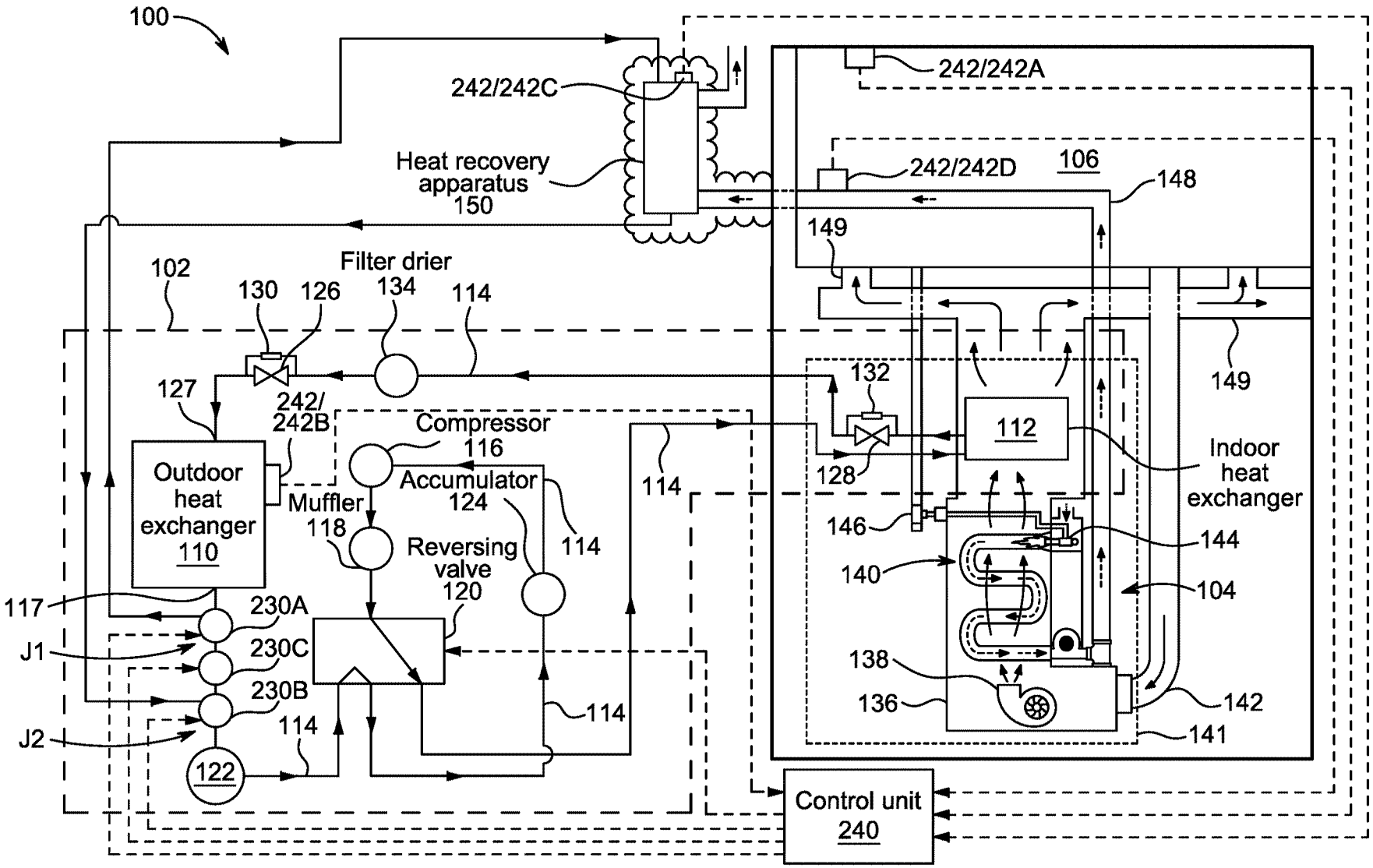
FIG. 1 is a schematic block diagram of a hybrid heating system having a heat recovery apparatus, according to an embodiment of the present disclosure.

Referring to FIG. 1, a schematic block diagram of a hybrid heating system 100 is illustrated, according to an embodiment of the present disclosure. The hybrid heating system 100 includes a heat pump 102 and a furnace 104 in fluid contact with each other. The heat pump 102 is used for conditioning air, that is heating or cooling of air to a desired temperature, within a closed space 106. In heating mode, the t furnace 104 works in tandem with the heat pump 102 to meet a desired heating load when the temperature of the air within the closed space 106 is low and the heat pump 102 alone is not able to meet the desired heating load. The heat pump 102 includes an outdoor heat exchanger 110, which is acting as an evaporator 110, and an indoor heat exchanger 112, which is acting as a condenser 112, fluidly and cyclically communicated to each other via multiple heat pump conduits 114. The indoor heat exchanger 112 is disposed in fluid contact with the closed space 106 and the outdoor heat exchanger 110 is disposed outside the closed space 106 to exchange heat with ambient air. In an example, the outdoor heat exchanger 110 may be a liquid-to-refrigerant heat exchanger or an air-to-refrigerant heat exchanger. The outdoor heat exchanger 110 and the indoor heat exchanger 112 are fluidly coupled with the heat pump conduits 114 and configured to allow a stream of refrigerant to flow therethrough in a cyclic manner.

The heat pump 102 further includes a compressor 116 fluidly coupled with the heat pump conduits 114 and disposed between the outdoor heat exchanger 110 and the indoor heat exchanger 112 at a downstream end 117 of the of the outdoor heat exchanger 110. A muffler 118 may be connected to the compressor 116 to deaden any undue noise that may be generated by the compressor 116 when the heat pump 102 is an operating mode. Further, the heat pump 102 includes a reversing valve 120 disposed in fluid communication with the outdoor heat exchanger 110, the indoor heat exchanger 112 and the compressor 116. The reversing valve 120 is configured to reverse flow of the stream of refrigerant between the outdoor heat exchanger 110 and the indoor heat exchanger 112 such that the heat pump 102 can be operated in a heating mode and a cooling mode. During the heating operation, the reversing valve 120 may be actuated for a shorter period to operate the heat pump 102 in the cooling mode, which is otherwise referred to as a defrosting mode. In the heating mode, the reversing valve 120 allows flow of refrigerant such that the outdoor heat exchanger 110 act as an evaporator and the indoor heat exchanger 112 acts as a condenser, whereas, in the cooling mode, the reversing valve 120 allows flow of the refrigerant such that the indoor heat exchanger 112 act as an evaporator and the outdoor heat exchanger 110 act as a condenser. The heat pump 102 may further include a charge compensator 122 fluidly coupled with the heat pump conduits 114 and disposed between the outdoor heat exchanger 110 and the reversing valve 120. The charge compensator 122 may be configured to receive certain quantity of the refrigerant out of circulation during the heating mode and return the refrigerant back to the circulation during the cooling mode. The heat pump 102 may further include an accumulator 124 fluidly coupled with the heat pump conduits 114 and disposed between the compressor 116 and the reversing valve 120. The accumulator 124 is configured to receive moisture content of refrigerant before the refrigerant reaches the compressor 116.

The heat pump 102 further includes a first expansion valve 126 fluidly coupled with the heat pump conduits 114 and disposed between the outdoor heat exchanger 110 and the indoor heat exchanger 112 at an upstream end 127 of the of the outdoor heat exchanger 110, and a second expansion valve 128 fluidly coupled with the heat pump conduits 114 and disposed between the outdoor heat exchanger 110 and the indoor heat exchanger 112 at a downstream end of the indoor heat exchanger 112. The first expansion valve 126 and the second expansion valve 128 may be parallelly connected with a first flow check valve 130 and a second flow check valve 132, respectively, to allow flow of the refrigerant when the corresponding expansion valve is not operational during the heating mode and the cooling mode. In an example, the first expansion valve 126 and the second expansion valve 128 may be unidirectional, i.e., allow flow of the refrigerant in only one direction. The heat pump 102 further includes a filter drier 134 fluidly coupled with the heat pump conduits 114 and disposed between the first expansion valve 126 and the second expansion valve 128. The filter drier 134 is configured to remove contaminants from the refrigerant while flowing therethrough.

The indoor heat exchanger 112 is configured to fluidly contact with the furnace 104 which receives air from the closed space 106 or ambient air and supply warm air to the closed space 106 in addition to the heat supplied by the heat pump 102. The furnace 104 includes a housing 136 to accommodate an air blower 138 and a combustion chamber 140. The air blower 138 may be disposed at bottom of the housing 136 and configured to receive the air from the closed space 106 via an air inlet duct 142. The combustion chamber 140 having a fuel burner 144 is configured to heat the air supplied by the air blower 138. The combustion chamber 140 is in fluid communication with a gas inlet duct 146, through which a gas fuel may be supplied to the fuel burner 144. Further, the combustion chamber 140 is in fluid communication with a flue gas duct 148 to discharge a flue gas therethrough. The indoor heat exchanger 112 of the heat pump 102 is disposed above the combustion chamber 140 such that the heated air coming out of the combustion chamber 140 may be further heated by the stream of high temperature refrigerant flowing through the indoor heat exchanger 112. Such heated air is supplied to the closed space 106 using an air outlet duct 149 that is in fluid communication with the indoor heat exchanger 112 to meet the desired heating load within the closed space 106. In some embodiments, the indoor heat exchanger 112 of the heat pump 102 may be disposed below the combustion chamber 140, or the furnace 104, or disposed either of the sides of the furnace 104 in accordance with an air flow path of the furnace 104. The indoor heat exchanger 112, the combustion chamber 140 and the air blower 138 together constitute an air handler 141 of the hybrid heating system 100. The air handler 141 is configured to condition the air, such as the process of heating or cooling the air, within the closed space 106.

The hybrid heating system 100 further includes an apparatus 150, which is alternatively referred to as 'the heat recovery apparatus 150', for recovering heat from the flue gas discharged from the furnace 104. The heat recovery apparatus 150 is further configured to exchange the recovered heat energy with a stream of refrigerant in the heat pump 102 to increase energy efficiency of the hybrid heating system 100 during the heating mode.

Figure 2:
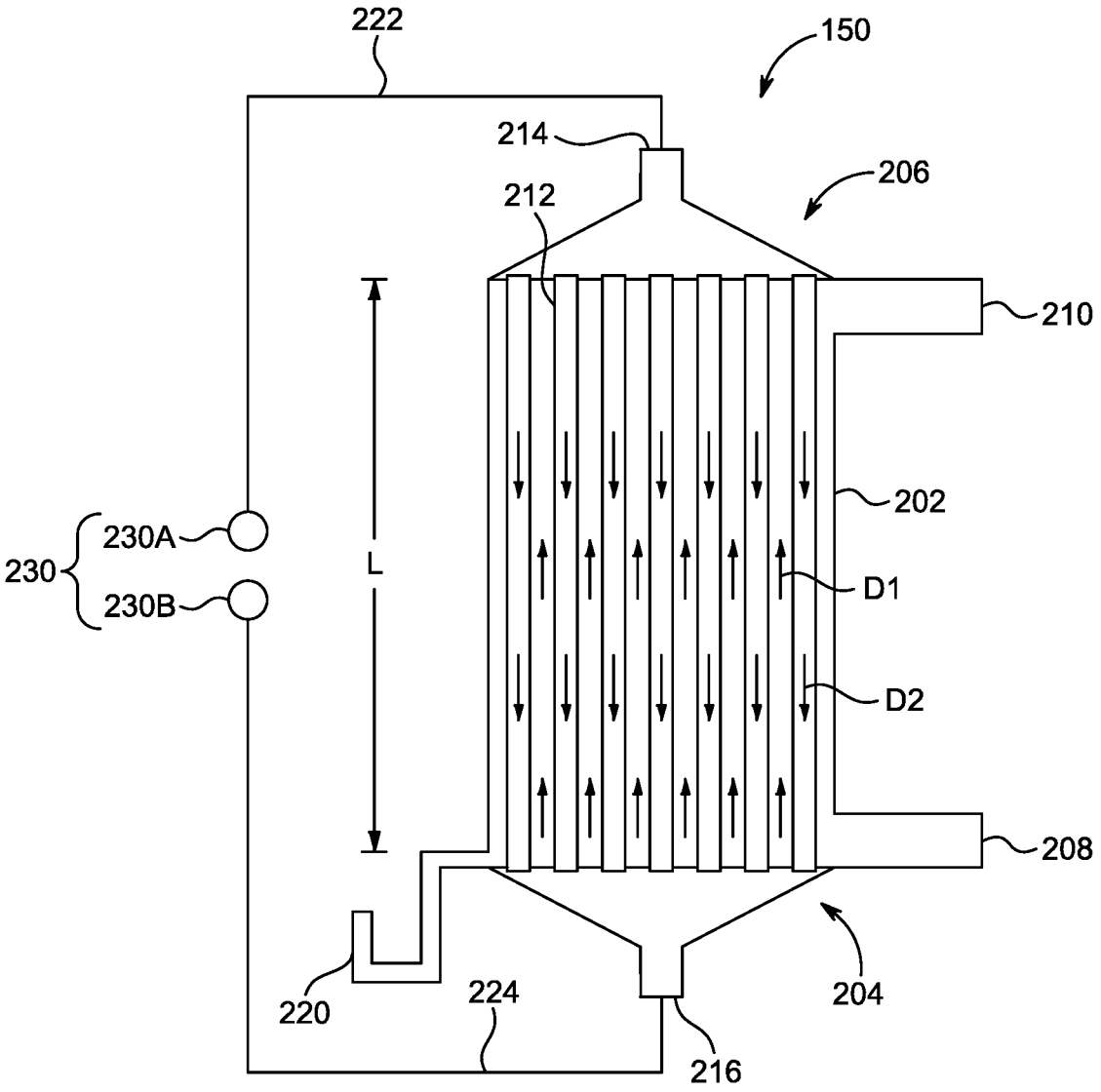
FIG. 2 is a schematic diagram of the heat recovery apparatus of FIG. 1, according to an embodiment of the present disclosure.

Referring to FIG. 2, a schematic diagram of the heat recovery apparatus 150 is illustrated, according to an embodiment of the present disclosure. The heat recovery apparatus 150 includes a shell 202 disposed in fluid communication with the furnace 104. The shell 202 may be an elongated hollow body having a length 'L' defined between a first end 204 and a second end 206. In one embodiment, the length 'L' of the shell 202 may be one foot. In some embodiments, the length 'L' of the shell 202 may be more than one foot. The shell 202 is disposed in fluid communication with the furnace 104 in such a way that the shell 202 allows the flue gas to flow therethrough in a first direction 'D1'. In one embodiment, the shell 202 may be a single hollow body configured to allow the flue gas to flow therethrough in the first direction 'D1'. The shell 202 includes an inlet port 208 defined at the first end 204 and fluidly coupled with the flue gas duct 148 of the furnace 104. The inlet port 208 is fluid tightly coupled with the flue gas duct 148 and configured to receive the flue gas from the flue gas duct 148. The shell 202 further includes an outlet port 210 defined at the second end 206 and configured to discharge the flue gas to atmosphere. As such, the flue gas received within the shell 202 flows from the inlet port 208 to the outlet port 210 in the first direction 'D1'. The shell 202 may be made of polyvinyl chloride (PVC), metals or metal alloys such as stainless steel and aluminum.

The heat recovery apparatus 150 further includes one or more tubes 212 disposed in fluid contact with the shell 202. In case of the single hollow body shell, the one or more tubes 212 may be disposed within the shell 202. The one or more tubes 212 are fluidly communicated with the stream of the refrigerant in the heat pump 102, as such the one or more tubes 212 allow the stream of the refrigerant to flow therethrough in a second direction 'D2'. The one or more tubes 212 may have a length equal to the length 'L' of the shell 202 and are disposed along the length 'L' of the shell 202. The tubes 212 define an inlet end 214 at the second end 206 of the shell 202 and an outlet end 216 at the first end 204 of the shell 202. The inlet end 214 and the outlet end 216 are together configured to fluidly couple with the stream of the refrigerant in the heat pump 102 such that the refrigerant flows from the inlet end 214 to the outlet end 216 in the second direction 'D2'. The one or more tubes 212 may be made of metals or metal alloys such as stainless steel, aluminum, or any other high thermally conductive material that has better acid corrosion properties from acidic gas flue moisture condensate. In some embodiments, the tubes 212 may be a group of micro or mini channels stacked together to allow the refrigerant to flow therethrough in the second direction 'D2'. In such a case, the shell 202 and the micro or mini channels of the tubes 212 may be alternatively stacked to make fluid contact with each other. Further, the one or more tubes 212 can be smooth tube or have enhanced heat transfer surface to improve heat transfer.

The second direction 'D2' of the flow of the stream of refrigerant is different from the first direction 'D1' of the flow of the flue gas. In one embodiment, the second direction 'D2' of the flow of the stream of refrigerant is parallel and opposite to the first direction 'D1' of the flow of the flue gas. Such arrangement of the flow of refrigerant and the flue gas is otherwise referred to as a counter flow arrangement. The counter flow arrangement may improve rate of heat transfer between the flue gas and the refrigerant which in turn may cause increase in heat transfer efficiency of the heat recovery apparatus 150. In another embodiment, the second direction 'D2' of the flow of stream of the refrigerant is perpendicular to the first direction 'D1' of the flow of the flue gas. In such a case, fins, or baffles (not shown) may be disposed transverse to the length 'L' of the shell 202. In some embodiments, the second direction 'D2' of the flow of stream of the refrigerant is parallel and identical to the first direction 'D1' of the flow of the flue gas.

The heat recovery apparatus 150 further includes a container 220 disposed proximate a bottom end of the shell 202 and configured to collect condensate therefrom. During the operation of the hybrid heating system 100, if the flue gas contains moisture, then the moisture may condensate and collected in the container 220. The container 220 is located at the bottom end of the heat recovery apparatus 150 such that the condensate may flow down due to gravity and received in the container 220. In an embodiment, the container 220 may be movably and adjustably coupled to the shell 202 of the heat recovery apparatus 150 such that the container 220 may be located at the bottom end of the shell 202 based on orientation of the heat recovery apparatus 150 during implementation thereof. In one implementation, the heat recovery apparatus 150 may be vertically disposed, and in another implementation, the heat recovery apparatus 150 may be horizontally disposed. In one embodiment, the container 220 may be disposed at the first end 204 of the shell 202 when the heat recovery apparatus 150 is vertically disposed during implementation. In another embodiment, the container 220 may be disposed parallel along the length 'L' of the shell 202 at the bottom end thereof when the heat recovery apparatus 150 is horizontally disposed during implementation. The condensate collected in a trap section of the container 220 may further help in preventing the flue gas from escaping through the container 220. Further, the condensate collected in the container 220 may be further treated for acid neutralization thereby the water can be further utilized for commercial use or could be disposed as waste. The heat recovery apparatus 150 including the one or more tubes 212 and the shell 202 may be fully insulated to avoid transfer of heat to the ambient thereby reduce heat loss in the heat recovery apparatus 150.

The heat recovery apparatus 150 further includes an inlet conduit 222 and an outlet conduit 224 configured to fluidly communicate with the inlet end 214 and the outlet end 216, respectively, of the one or more tubes 212. In one embodiment, the inlet conduit 222 and the outlet conduit 224 may be a pipe made of nonflexible material such as a metal. In another embodiment, the inlet conduit 222 and the outlet conduit 224 may be a hose made of flexible material such as elastomers. The inlet conduit 222 and the outlet conduit 224 are configured to fluid tightly couple with the stream of the refrigerant in the heat pump 102. The stream of the refrigerant in the heat pump 102 is otherwise referred to as a portion of the heat pump conduit 114 through which the refrigerant flows at a desired pressure.

The heat recovery apparatus 150 further includes one or more valves 230 disposed in at least one of the inlet conduit 222 and the outlet conduit 224. The valves 230 may include one or more isolation valves, one or more check valves, and a combination thereof based on application of the hybrid heating system 100. The one or more valves 230 are configured to regulate access between the heat recovery apparatus 150 and the heat pump 102 during the heating mode based on one or more operating parameters of the hybrid heating system 100. The one or more valves 230 are also configured to selectively disconnect the heat recovery apparatus 150 from the heat pump 102 during the cooling mode/defrosting mode based on the one or more operating parameters of the hybrid heating system 100. In an embodiment, the one or more valves 230 may be electronically actuated valves.

Referring to FIG. 1 and FIG. 2, the heat recovery apparatus 150 is disposed in fluid contact with the flue gas duct 148 of the furnace 104. Particularly, the inlet port 208 of the shell 202 is fluidly coupled with the flue gas duct 148. The heat recovery apparatus 150 is implemented in such a way that the outlet port 210 of the shell 202 may discharge the flue gas to atmosphere. In one implementation, the heat recovery apparatus 150 may be disposed indoor. In another implementation, the heat recovery apparatus 150 may be disposed outdoor. The inlet end 214 and the outlet end 216 of the one or more tubes 212 of the heat recovery apparatus 150 are fluid tightly coupled with the downstream end 117 of the outdoor heat exchanger 110 using the inlet conduit 222 and the outlet conduit 224, respectively. More particularly, the inlet conduit 222 is coupled to the heat pump conduit 114 at a first junction 'J1' at the downstream end 117 of the outdoor heat exchanger 110. Further, the outlet conduit 224 is coupled to the heat pump conduit 114 at a second junction 'J2' at the downstream end 117 of the outdoor heat exchanger 110, such that the heat recovery apparatus 150 is fluidly coupled with the stream of the refrigerant in series with the outdoor heat exchanger 110 of the heat pump 102. The hybrid heating system 100 further includes the one or more valves 230 configured to regulate the access between the heat recovery apparatus 150 and the stream of the refrigerant in the heat pump 102. In one embodiment, the hybrid heating system 100 includes a first isolation valve 230A disposed at the first junction 'J1' between the inlet conduit 222 and the heat pump conduit 114, a second isolation valve 230B disposed at the second junction 'J2' between the outlet conduit 224 and the heat pump conduit 114, and a third isolation valve 230C disposed in the heat pump conduit 114 between the first isolation valve 230A and the second isolation valve 230B. The first isolation valve 230A, the second isolation valve 230B, and the third isolation valve 230C are collectively referred to as 'the valves 230' and individually referred to as 'the valve 230' unless otherwise specifically mentioned.

The hybrid heating system 100 further includes a control unit 240 in communication with the valves 230 such as the first isolation valve 230A, the second isolation valve 230B and the third isolation valve 230C. The control unit 240 is configured to regulate the access between the heat recovery heat recovery apparatus 150 and the heat pump 102 during the heating mode based on the one or more operating parameters of the hybrid heating system 100. The control unit 240 may also be in electric communication with the reversing valve 120 of the heat pump 102 to actuate the reversing valve 120 and thereby to selectively operate the hybrid heating system 100 in the heating mode and the cooling mode based on the operating parameters of the hybrid heating system 100. In some embodiments, the control unit 240 may also be in communication with the furnace 104 to control electronic controlled valves (not shown) used for controlling supply of gas fuel through the gas inlet duct 146.

In some embodiments, the control unit 240 may be in communication with the compressor 116 to control a speed of a motor and an inverter drive thereof. Further, the compressor 116 may include pressure limit sensors and discharge pressure sensors in communications with the control unit 240. If discharge pressure exceeds a desired upper limit pressure, or if suction pressure exceeds a desired lower limit pressure, the compressor 116 may be turned off. Also, if the discharge pressure is too low, then it indicates loss of heat load at the outdoor heat exchanger 110 in the heating mode or formation of frost on the outdoor heat exchanger 110. The control unit 240 may also be in communication with the first and second expansion valves 126, 128 if they are electronically controlled valves. The control unit 240 may also communicate with a defrost sensor placed on the outdoor heat exchanger 110. Further, the control unit 240 may be configured to control speed of the air blower 138. In some embodiments, the outdoor heat exchanger 110 may be a liquid-to-refrigerant heat exchanger, in such a case the control unit 240 may control operation of pump used for supplying liquid. In some embodiments, the outdoor heat exchanger 110 may be an air-to-refrigerant heat exchanger, in such a case the control unit 240 may control operation of air fan used for controlling flow of air.

The control unit 240 may be an electronic controller that operates in a logical fashion to perform operations, execute control algorithms, store and retrieve data and other desired operations. The control unit 240 may include access memory, secondary storage devices, processors, and any other components for running an application. The memory and secondary storage devices may be in the form of read-only memory (ROM) or random-access memory (RAM) or integrated circuitry that is accessible by the control unit 240. Various other circuits may be associated with the control unit 240 such as power supply circuitry, signal conditioning circuitry, driver circuitry, and other types of circuitries. Further, the control unit 240 may be a single controller or may include multiple controllers disposed to control various functions and/or features of the hybrid heating system 100. The term "controller" is meant to be used in its broadest sense to include one or more controllers and/or microprocessors that may be associated with the hybrid heating system 100 and that may cooperate in controlling various functions and operations of the hybrid heating system 100. The control unit 240 may rely on data relating to preset data of various components of the hybrid heating system 100 as well as the lab test data captured based on the operational experiments of the hybrid heating system 100, which may be stored in the memory of the control unit 240. The data may be presented in the form of tables, graphs, and/or equations.

The hybrid heating system 100 further includes one or more sensing devices 242 configured to communicate inputs indicative of the one or more operating parameters of the hybrid heating system 100 with the control unit 240. In one embodiment, the sensing devices 242 include a first sensor 242A configured to generate an input signal indicative of temperature of the air within the closed space 106, a second sensor 242B configured to generate an input signal indicative of temperature of the refrigerant flowing through the outdoor heat exchanger 110, a third sensor 242C configured to generate an input signal indicative of temperature of the refrigerant flowing through the heat recovery apparatus 150, and a fourth sensor 242D configured to generate an input signal indicative of temperature of the flue gas entering the heat recovery apparatus 150 through the flue gas duct 148. The first sensor 242A, the second sensor 242B, the third sensor 242C, and the fourth sensor 242D may be collectively referred to as 'the sensing devices 242' and individually referred to as 'the sensing device 242' unless otherwise specifically mentioned. In some embodiments, the flue gas duct 148 may be provided with a sensor to generate an input signal indicative of flow of the flue gas therethrough. In some embodiments, the hybrid heating system 100 may include multiple sensors disposed on the compressor 116, the first expansion valve 126, the second expansion valve 128, and the indoor heat exchanger 112 to generate input signals indicative of the pressure and the temperature of the refrigerant flowing through the heat pump conduit 114 at various stages of the cyclic operation of the heat pump 102.

During the heating mode, the refrigerant enters the outdoor heat exchanger 110. The refrigerant is at low temperature compared to temperature of the ambient air such that the refrigerant that enters the outdoor heat exchanger 110 becomes vapor as the heat from the ambient air is transferred to the refrigerant. The refrigerant further enters the compressor 116 via the reversing valve 120. The refrigerant is compressed by the compressor 116 to higher pressure such that the temperature of the refrigerant becomes greater than the temperature of the ambient air. Such high temperature refrigerant flows through the reversing valve 120 and enters the indoor heat exchanger 112 that is in communication with the closed space 106. As the temperature of the refrigerant is greater than the temperature of the air in the closed space 106 and temperature of air flowing through the indoor heat exchanger 112, the heat from the refrigerant is transferred to the flowing air and the air in the closed space 106. Thus, the air within the closed space 106 is heated to achieve the desired heating load within the closed space 106. The low temperature and low-pressure refrigerant flows through the first expansion valve 126 and the second flow check valve 132, as the second expansion valve 128 is not operational and the first flow check valve 130 does not allow the refrigerant to flow therethrough. At the first expansion valve 126, the warm refrigerant further drops the temperature and the pressure and becomes two-phase form of the refrigerant and enters the outdoor heat exchanger 110. Thus, the pattern of operation continues cyclically to serve the heat load of the closed space 106. During the heating mode, the first isolation valve 230A and the second isolation valve 230B are shut down to disconnect the heat recovery apparatus 150 from the heat pump 102, whereas the third isolation valve 230C is actuated in an open position to allow flow of the refrigerant therethrough.

In an embodiment, when the control unit 240 determines that the heat pump 102 is not able to meet the desired heating load within the closed space 106 after certain number of cyclic operations, the control unit 240 may actuate the furnace 104 to burn the gas fuel to provide additional heat energy within the closed space 106. Particularly, the air within the closed space 106 is sucked by the air blower 138 and allowed to flow through the combustion chamber 140, in which the air is further heated when flowing over the furnace 104 where combustion of fuel happens inside, and flow across the indoor heat exchanger 112. As such, the additional heat energy is transferred to the closed space 106 apart from the heat energy provided by the heat pump 102. The control unit 240 may initiate the operation of the furnace 104 based on the input signal indicative of the temperature of the air within the closed space 106 received from the first sensor 242A. In an embodiment, the control unit 240 may determine the desired heating load to be established within the closed space 106 based on inputs received from a user. The desired heating load may be defined as a rate at which the air within the closed space 106 is heated to achieve a desired temperature. The control unit 240 may further determine the temperature of the air within the closed space 106, with respect to time, based on the input signal received from the first sensor 242A may be after every cyclic operation of the heat pump 102. Further, the control unit 240 may compare the determined temperature value of the air with the desired heating load. If the temperature of the air within the closed space 106 for a predefined time is less than the desired heating load, then the control unit 240 may actuate the furnace 104. When the furnace 104 also put in operation to meet the desired heating load within the closed space 106, the control unit 240 actuates the first isolation valve 230A and the second isolation valve 230B to an open position, whereas the third isolation valve 230C is kept in a closed position. As such, the heat recovery apparatus 150 establishes fluid communication with the heat pump 102 in series with the outdoor heat exchanger 110 at the downstream end 117 thereof.

The shell 202 of the heat recovery apparatus 150 receives the flue gas that is discharged from the furnace 104. As the flue gas flows through the shell 202 from the inlet port 208 to the outlet port 210, the heat from the flue gas is transferred to the refrigerant flowing through the tubes 212 from the inlet end 214 to the outlet end 216. Thus, the heat recovery apparatus 150 is configured to recover heat from the flue gas discharged from the furnace 104 and transfer the recovered heat to the stream of the refrigerant in the heat pump 102. With the series connection of the heat recovery apparatus 150 with the outdoor heat exchanger 110 at the downstream end 117 thereof, the refrigerant exiting the outdoor heat exchanger 110 is further heated by the heat recovery apparatus 150 before reaching to the compressor 116. Thus, the heat recovery apparatus 150 is configured to supply refrigerant to the stream of the refrigerant in the heat pump 102 during the heating mode of the hybrid heating system 100.

Figure 4:
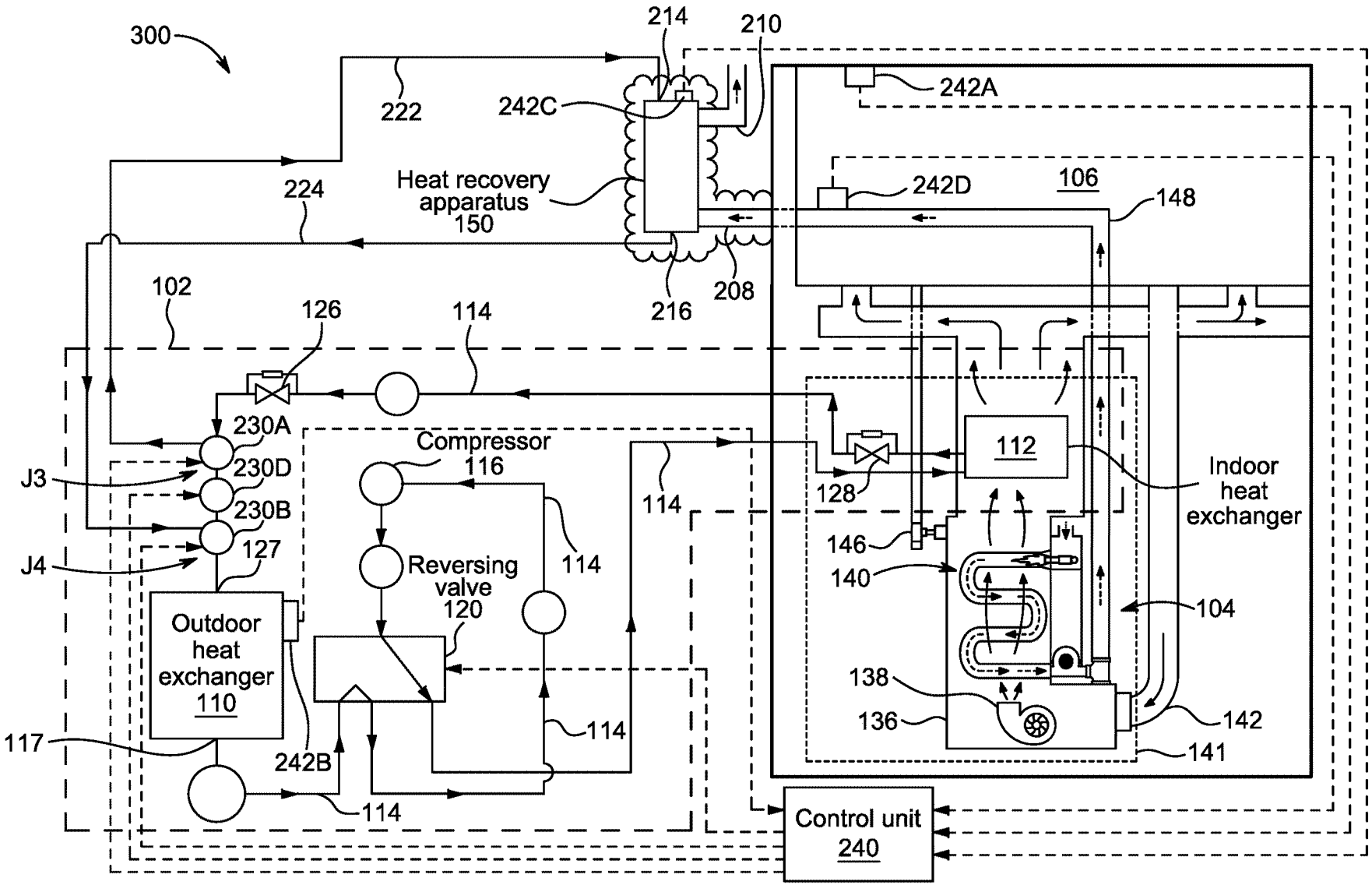
FIG. 4 is a schematic block diagram of a hybrid heating system having the heat recovery apparatus connected in series with an outdoor heat exchanger, according to an embodiment of the present disclosure.

When the refrigerant inside the outdoor heat exchanger 110 is not able to absorb enough heat energy from outside air flowing over the outdoor heat exchanger 110 and accompanied by drop in refrigerant pressure as it is sucked by the compressor 116, the refrigerant temperature inside the outdoor heat exchanger 110 can fall below water freezing temperature. This causes moisture from outside ambient air to freeze or frost on the outdoor heat exchanger 110. In FIG. 1 or FIG. 4, the heat recovery apparatus 150 will have the refrigerant gain energy from flue gas, which will prevent or delay the drop of refrigerant pressure and temperature inside the outdoor heat exchanger 110 and thus helps to delay frost formation of the outdoor heat exchanger 110.

When the refrigerant inside the outdoor heat exchanger 110 is not able to absorb enough heat energy from the outside air flowing over the outdoor heat exchanger 110 and accompanied by drop in refrigerant pressure as it is sucked by the compressor 116, the refrigerant temperature inside the outdoor heat exchanger 110 can fall below water freezing temperature, which causes moisture from the outside ambient air to freeze or frost on the outdoor heat exchanger 110. The control unit 240 can sense one or more of the second sensor 242B, the defrost sensor, and suction pressures at the inlet of the compressor 116 and thereby initiate a defrost cycle.

Figure 3:
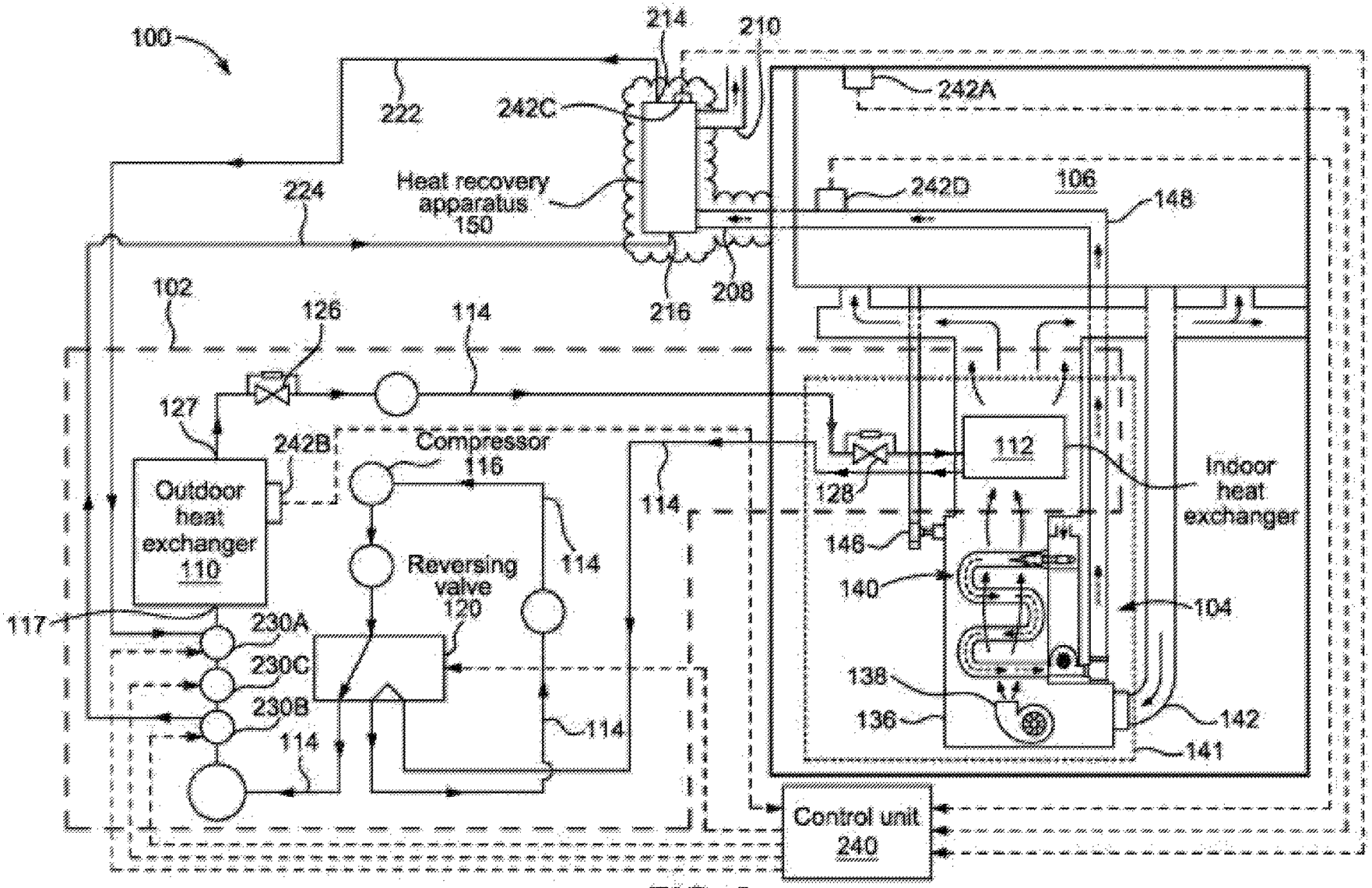
FIG. 3 is a schematic block diagram of the hybrid heating system operating in a defrosting mode, according to an embodiment of the present disclosure.

Referring to FIG. 3, a schematic block diagram of the hybrid heating system 100 operating in the defrosting mode is illustrated, according to an embodiment of the present disclosure. During the heating mode, the outdoor heat exchanger 110 may frost and lose capacity, which may lead to drop in the expected performance of the hybrid heating system 100. In such a scenario, the heat pump 102 may be operated at the defrosting mode for a predetermined time to defrost the outdoor heat exchanger 110.

During the defrosting mode, the control unit 240 may actuate the reversing valve 120 to direct flow of the high-pressure refrigerant from the compressor 116 to the outdoor heat exchanger 110 to act as a refrigerant condenser for short period of time. In an embodiment, the second sensor 242B that is in communication with the control unit 240 may provide the input signal indicative of the temperature of the refrigerant in the outdoor heat exchanger 110. The control unit 240 may determine the temperature of the refrigerant in the outdoor heat exchanger 110 and compare the determined temperature value of the outdoor heat exchanger 110 with a threshold temperature value of the outdoor heat exchanger 110 that is preset in the control unit 240. If the determined temperature value of the outdoor heat exchanger 110 is smaller than the threshold temperature value, then the control unit 240 may actuate the reversing valve 120 to direct flow of the refrigerant from the compressor 116 to the outdoor heat exchanger 110. As such, the high temperature refrigerant flows through the reversing valve 120 and enters the outdoor heat exchanger 110. Simultaneously, as the temperature of the refrigerant is greater than the temperature of the ambient air and frost on the outdoor heat exchanger 110, the heat from the refrigerant is transferred to the ambient air and frost to melt the frost (or defrost). The high temperature refrigerant that flows from the compressor 116 help to defrost the outdoor heat exchanger 110 in a first time period. The first time period may be defined as the amount of time taken by the heat pump 102 to defrost the outdoor heat exchanger 110 when only the heat pump 102 is operating in the heating mode to meet the desired heating load within the closed space 106.

When the furnace 104 also put in operation to meet the desired heating load within the closed space 106, the first isolation valve 230A and the second isolation valve 230B also actuated to the open position by the control unit 240 to regulate the access between the heat pump 102 and the heat recovery apparatus 150. The connection of the heat recovery apparatus 150 at the downstream end 117 of the outdoor heat exchanger 110 in series therewith causes the high temperature refrigerant to flow through the heat recovery apparatus 150 before enters the outdoor heat exchanger 110. When the high temperature refrigerant flows through the heat recovery apparatus 150, the heat from the flue gas is transferred to the high-pressure refrigerant, when flue gas temperature is higher than the refrigerant temperature, which is circulated back to the outdoor heat exchanger 110. Such super-heated refrigerant help to defrost the outdoor heat exchanger 110 in a second time period which is smaller than the first time period. The second time period may be defined as the amount of time taken by the heat pump 102 to defrost the outdoor heat exchanger 110 when the heat pump 102, the furnace 104, and the heat recovery apparatus 150 are operating together in the heating mode to meet the desired heating load within the closed space 106. Thus, the addition of the heat recovery apparatus 150 in series connection with the outdoor heat exchanger 110 help the hybrid heating system 100 to reduce the defrosting time.

Referring to FIG. 4, a schematic block diagram of a hybrid heating system 300 having the heat recovery apparatus 150 connected in series with the outdoor heat exchanger 110 is illustrated, according to an embodiment of the present disclosure. Referring to FIG. 2 and FIG. 4, the heat recovery apparatus 150 is disposed in fluid contact with the flue gas duct 148 of the furnace 104. Particularly, the inlet port 208 of the shell 202 is fluidly coupled with the flue gas duct 148. The inlet end 214 and the outlet end 216 of the one or more tubes 212 of the heat recovery apparatus 150 are fluid tightly coupled with the upstream end 127 of the outdoor heat exchanger 110 using the inlet conduit 222 and the outlet conduit 224, respectively. More particularly, the inlet conduit 222 is coupled to the heat pump conduit 114 at a first junction 'J3' at the upstream end 127 of the outdoor heat exchanger 110. Further, the outlet conduit 224 is coupled to the heat pump conduit 114 at a second junction 'J4' at the upstream end 127 of the outdoor heat exchanger 110, such that the heat recovery apparatus 150 is fluidly coupled with the stream of the refrigerant in series with the outdoor heat exchanger 110 of the heat pump 102. The hybrid heating system 300 further includes the one or more valves 230 configured to regulate the access between the heat recovery apparatus 150 and the stream of the refrigerant in the heat pump 102. In one embodiment, the hybrid heating system 300 includes the first isolation valve 230A disposed at the first junction 'J3' between the inlet conduit 222 and the heat pump conduit 114, the second isolation valve 230B disposed at the second junction 'J4' between the outlet conduit 224 and the heat pump conduit 114, and a third isolation valve 230D disposed in the heat pump conduit 114 between the first isolation valve 230A and the second isolation valve 230B.

The hybrid heating system 300 further includes the control unit 240 in communication with the valves 230 such as the first isolation valve 230A, the second isolation valve 230B and the third isolation valve 230D. The control unit 240 is configured to regulate the access between the heat recovery apparatus 150 and the heat pump 102 during the heating mode based on the one or more operating parameters of the hybrid heating system 300. The hybrid heating system 300 further includes the sensing devices 242 such as the first sensor 242A, the second sensor 242B, and the third sensor 242C and configured to communicate inputs indicative of the one or more operating parameters of the hybrid heating system 300 with the control unit 240.

During the heating mode, when the heat pump 102 is operating alone, the first isolation valve 230A and the second isolation valve 230B are shut down to disconnect the heat recovery apparatus 150 from the heat pump 102, whereas the third isolation valve 230D is actuated in an open position to allow flow of the refrigerant therethrough. When the control unit 240 determines that the heat pump 102 is not able to meet the desired heating load within the closed space 106 after certain number of cyclic operations, the control unit 240 may actuate the furnace 104 to burn the gas fuel to provide additional heat energy within the closed space 106. The control unit 240 may initiate the operation of the furnace 104 based on the input signal indicative of the temperature of the air within the closed space 106 received from the first sensor 242A. When the furnace 104 also put in operation to meet the desired heating load within the closed space 106, the control unit 240 actuates the first isolation valve 230A and the second isolation valve 230B to an open position, whereas the third isolation valve 230D is kept in a closed position. As such, the heat recovery apparatus 150 establishes fluid communication with the heat pump 102 in series with the outdoor heat exchanger 110 at the upstream end 127 thereof.

The shell 202 of the heat recovery apparatus 150 receives the flue gas that is discharged from the furnace 104. As the flue gas flows through the shell 202 from the inlet port 208 to the outlet port 210, the heat from the flue gas is transferred to the refrigerant flowing through the tubes 212 from the inlet end 214 to the outlet end 216. Thus, the heat recovery apparatus 150 is configured to recover the heat from the flue gas discharged from the furnace 104 and transfer the recovered heat to the stream of the refrigerant in the heat pump 102. With the series connection of the heat recovery apparatus 150 with the outdoor heat exchanger 110 at the upstream end 127 thereof, the refrigerant exiting the heat recovery apparatus 150 may have increased enthalpy value before entering the outdoor heat exchanger 110.

Figure 5:
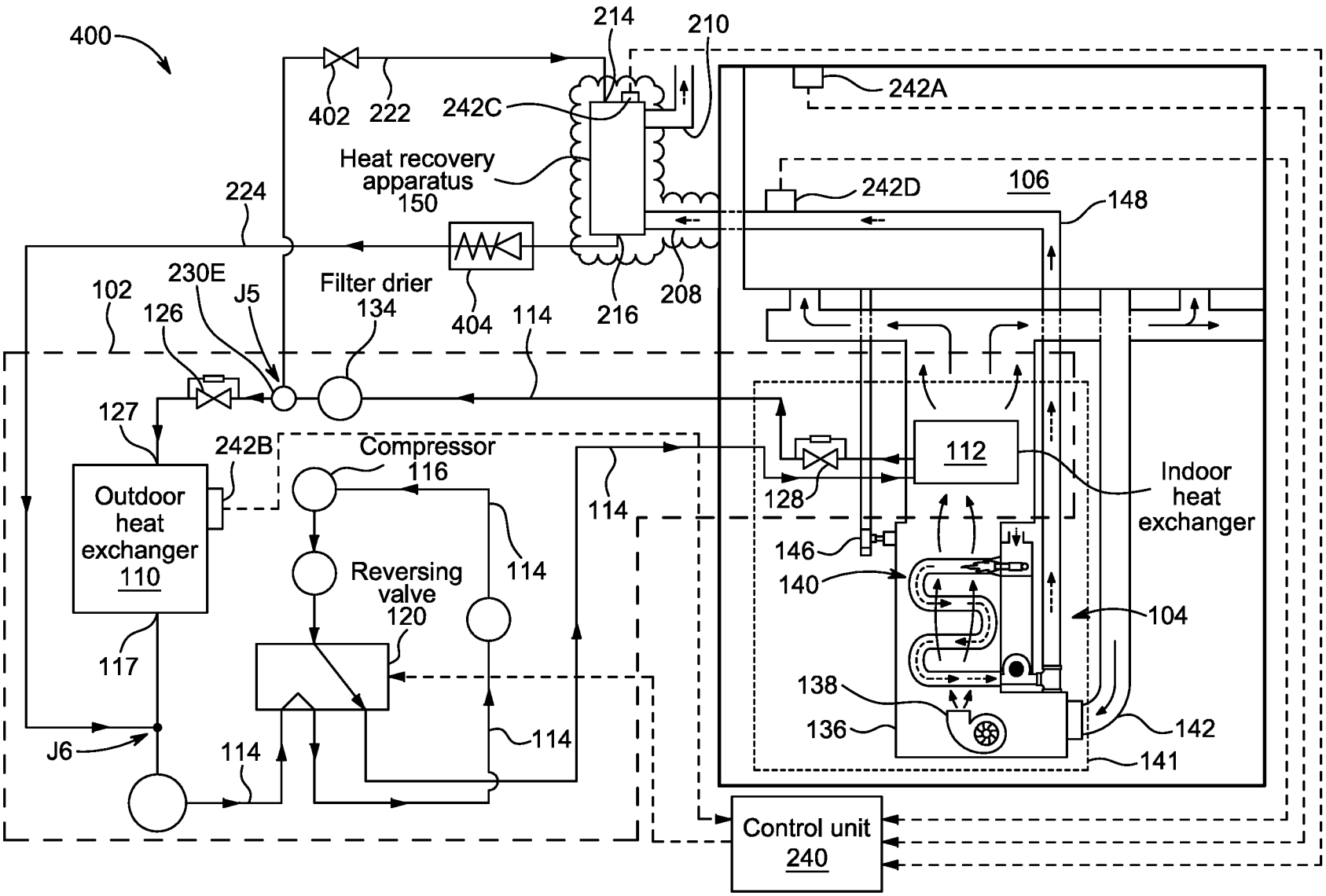
FIG. 5 is a schematic block diagram of a hybrid heating system having the heat recovery apparatus connected in parallel with the outdoor heat exchanger, according to an embodiment of the present disclosure.

Referring to FIG. 5, a schematic block diagram of a hybrid heating system 400 having the heat recovery apparatus 150 connected in parallel with the outdoor heat exchanger 110 is illustrated, according to an embodiment of the present disclosure. Referring to FIG. 2 and FIG. 5, the heat recovery apparatus 150 is disposed in fluid contact with the flue gas duct 148 of the furnace 104. Particularly, the inlet port 208 of the shell 202 is fluidly coupled with the flue gas duct 148. The inlet end 214 and the outlet end 216 of the one or more tubes 212 of the heat recovery apparatus 150 are fluid tightly coupled with the heat pump 102 using the inlet conduit 222 and the outlet conduit 224, respectively. More particularly, the inlet conduit 222 is coupled to the heat pump conduit 114 at a first junction 'J5' between the expansion valve 126 and the filter drier 134. An isolation valve 230E is disposed at the first junction 'J5' to prevent flow of the refrigerant in the inlet conduit 222 when in cooling mode. Further, the outlet conduit 224 is coupled to the heat pump conduit 114 at a second junction 'J6' at the downstream end 117 of the outdoor heat exchanger 110, such that the heat recovery apparatus 150 is fluidly coupled with the stream of the refrigerant in parallel with the outdoor heat exchanger 110 of the heat pump 102. Particularly, the inlet end 214 and the outlet end 216 of the one or more tubes 212 of the heat recovery apparatus 150 are fluidly coupled with the upstream end 127 and the downstream end 117, respectively, of the evaporator 110 of the heat pump 102.

The hybrid heating system 400 further includes an expansion valve 402 disposed on the inlet conduit 222. The expansion valve 402 may function identical to the first expansion valve 126 as such the outdoor heat exchanger 110 and the heat recovery apparatus 150 are associated with individual expansion valves such as the first expansion valve 126 and the expansion valve 402. The expansion valve 402 may be designed in such a way to allow flow of the refrigerant only when the refrigerant in the heat recovery apparatus 150 is sufficiently superheated. In an example, the expansion valve 402 may be unidirectional or bidirectional, i.e., allow flow of the refrigerant in one direction or both directions. The hybrid heating system 400 further includes a back pressure valve 404 disposed on the outlet conduit 224. The back pressure valve 404 is configured to maintain an evaporation pressure in the heat recovery apparatus 150 that is higher than the evaporation pressure at the downstream end 117 of the outdoor heat exchanger 110. Thereby, backflow of refrigerant from the outdoor heat exchanger 110 to the heat recovery apparatus 150 is prevented during the heating mode. In an embodiment, the back pressure valve 404 may be replaced with a flow check valve, in such a case, the outdoor heat exchanger 110 and the heat recovery apparatus 150 may operate at same pressure. In one embodiment, the back pressure valve 404 may be a spring loaded nonreturn valve. During the cooling mode, the back pressure valve 404 and the expansion valve 402 may isolate the heat recovery apparatus 150 from the heat pump 102 thereby prevent entry of refrigerant into the heat recovery apparatus 150. Particularly, the control unit 240 may actuate the reversing valve 120 to reverse the flow of the refrigerant. Such that the high-pressure refrigerant discharged from the compressor 116 flow through the reversing valve 120 and reaches to the outdoor heat exchanger 110. The back pressure valve 404 may be designed in such a way to restrict flow of the refrigerant to the heat recovery apparatus 150 due to the high pressure of the refrigerant exiting the compressor 116 during the cooling mode.

Figure 6:
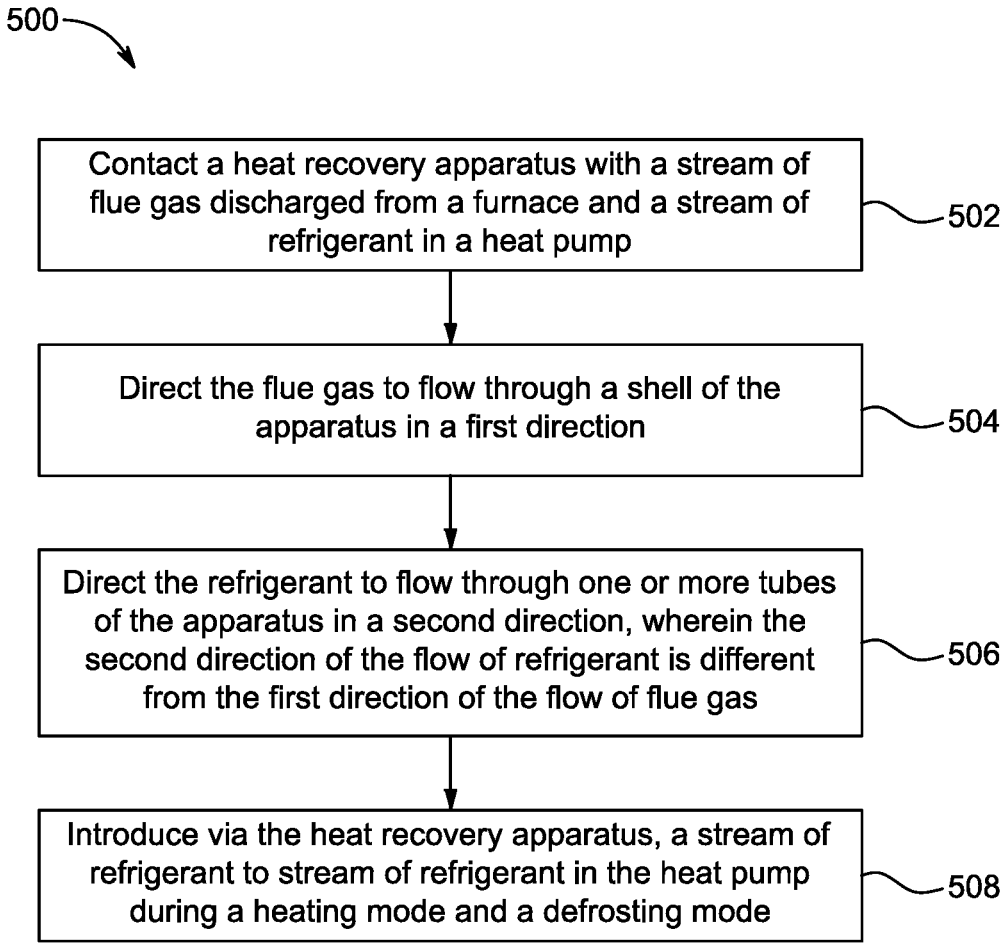
FIG. 6 is a flow diagram of a method of increasing energy efficiency of the hybrid heating system of FIG. 1, according to an embodiment of the present disclosure.

Referring to FIG. 6, a flow diagram of a method 500 of increasing energy efficiency of the hybrid heating system 100 is illustrated, according to an embodiment of the present disclosure. The method 500 is described with reference to the hybrid heating system 100 illustrated in FIG. 1, FIG. 2, and FIG. 3, although the method 500 is equally implemented in the hybrid heating systems 300 and 400. The method 500 may also be described in the general context of computer executable instructions which may be located in both, local and remote computer storage media, including memory storage devices of the control unit 240. The order in which the method 500 is described is not intended to be construed as a limitation, and any number of the described method steps can be combined in any order to implement the method 500. Additionally, individual steps may be deleted from the method 500 without departing from the spirit and scope of the present disclosure.

At step 502, the method 500 includes contacting the heat recovery apparatus 150 with the stream of the flue gas discharged from the furnace 104 and the stream of the refrigerant in the heat pump 102. The heat recovery apparatus 150 includes the shell 202 and the one or more tubes 212 disposed in contact with the shell 202. The heat recovery apparatus 150 is disposed in fluid contact with the flue gas duct 148 of the furnace 104. Particularly, the inlet port 208 of the shell 202 is fluidly coupled with the flue gas duct 148 and the outlet port 210 of the shell 202 is positioned in such a way to discharge the flue gas to the atmosphere. The inlet end 214 and the outlet end 216 of the one or more tubes 212 of the heat recovery apparatus 150 are fluid tightly coupled with the downstream end 117 of the outdoor heat exchanger 110 using the inlet conduit 222 and the outlet conduit 224, respectively.

At step 504, the method 500 includes directing the flue gas to flow through the shell 202 in the first direction 'D1'. The shell 202 is disposed in fluid communication with the furnace 104 in such a way that the shell 202 allows the flue gas to flow therethrough in the first direction 'D1'. The inlet port 208 defined at the first end 204 of the shell 202 is fluidly coupled with the flue gas duct 148 of the furnace 104. The inlet port 208 is fluid tightly coupled with the flue gas duct 148 to receive the flue gas from the flue gas duct 148. The outlet port 210 is defined at the second end 206 to discharge the flue gas to atmosphere. As such, the flue gas received within the shell 202 flows from the inlet port 208 to the outlet port 210 in the first direction 'D1'.

At step 506, the method 500 includes directing the stream of the refrigerant to flow through the one or more tubes 212 in the second direction 'D2'. The one or more tubes 212 are fluidly communicated with the stream of the refrigerant in the heat pump 102 in such a way to allow the stream of the refrigerant to flow therethrough in the second direction 'D2'. Particularly, the inlet conduit 222 is coupled to the heat pump conduit 114 at the first junction 'J1' at the downstream end 117 of the outdoor heat exchanger 110. The outlet conduit 224 is coupled to the heat pump conduit 114 at the second junction 'J2' at the downstream end 117 of the outdoor heat exchanger 110, such that the heat recovery apparatus 150 is fluidly coupled with the stream of the refrigerant in series with the outdoor heat exchanger 110 of the heat pump 102. The inlet end 214 and the outlet end 216 are together configured to fluidly couple with the stream of the refrigerant in the heat pump 102 via the inlet conduit 222 and the outlet conduit 224, respectively, such that the refrigerant flows from the inlet end 214 to the outlet end 216 in the second direction 'D2' during the heating mode.

The second direction 'D2' of the flow of the stream of the refrigerant is different from the first direction 'D1' of the flow of the flue gas. In one embodiment, the second direction 'D2' of the flow of the stream of the refrigerant is parallel and opposite to the first direction 'D1' of the flow of the flue gas. Such counter flow arrangement improves rate of heat transfer between the flue gas and the refrigerant which in turn causes increase in heat transfer efficiency of the heat recovery apparatus 150. In another embodiment, the second direction 'D2' of the flow of the stream of the refrigerant is perpendicular to the first direction 'D1' of the flow of the flue gas. In such a case, fins may be disposed perpendicular to the length 'L' of the shell 202.

At step 508, the method 500 includes introducing the stream of the refrigerant to the stream of the refrigerant in the heat pump 102 during the heating mode via the heat recovery apparatus 150. In the defrosting mode, the heat recovery apparatus 150 may exit superheated refrigerant that may be introduced to the heat pump 102. During the heating mode, the pattern of operation continues cyclically until the desired heating load is achieved within the closed space 106. When only the heat pump 102 is in operation during the heating mode, the first isolation valve 230A and the second isolation valve 230B are shut down to disconnect the heat recovery apparatus 150 from the heat pump 102, whereas the third isolation valve 230C is actuated in the open position to allow flow of the refrigerant therethrough. When the furnace also put in operation, the shell 202 of the heat recovery apparatus 150 receives the flue gas that is discharged from the furnace 104. As the flue gas flows through the shell 202 from the inlet port 208 to the outlet port 210, the heat from the flue gas is transferred to the refrigerant flowing through the tubes 212 from the inlet end 214 to the outlet end 216. Thus, the heat recovery apparatus 150 is configured to recover heat from the flue gas discharged from the furnace 104 and transfer the recovered heat to the stream of the refrigerant in the heat pump 102. With the series connection of the heat recovery apparatus 150 with the outdoor heat exchanger 110 at the downstream end 117 thereof, the refrigerant exiting the outdoor heat exchanger 110 is further heated by the heat recovery apparatus 150 before reaching the compressor 116. Thus, the heat recovery apparatus 150 is configured to supply the refrigerant to the stream of the refrigerant in the heat pump 102 during the heating mode of the hybrid heating system 100.

The method 500 further includes regulating the access between the heat recovery apparatus 150 and the heat pump 102 during the heating mode via the control unit 240 and the one or more valves 230 based on the one or more operating parameters of the hybrid heating system 100. When the control unit 240 determines that the heat pump 102 is not able to meet the desired heating load within the closed space 106 after certain number of cyclic operations, the control unit 240 actuates the furnace 104 to burn the gas fuel to provide additional heat energy within the closed space 106. As such, the additional heat energy is transferred to the closed space 106 apart from the heat energy provided by the heat pump 102. When the furnace 104 also put in operation to meet the desired heating load within the closed space 106, the control unit 240 actuates the first isolation valve 230A and the second isolation valve 230B to the open position, whereas the third isolation valve 230C is kept in the closed position. The control unit 240 in communication with the first isolation valve 230A, the second isolation valve 230B and the third isolation valve 230C regulates the access between the heat recovery apparatus 150 and the heat pump 102 during the heating mode based on the one or more operating parameters of the hybrid heating system 100. As such, the heat recovery apparatus 150 establishes fluid communication with the heat pump 102 in series with the outdoor heat exchanger 110 at the downstream end 117 thereof to supply the refrigerant that is in two-phase to the stream of the refrigerant in the heat pump 102 during the heating mode of the hybrid heating system 100.

In one embodiment, the method 500 includes fluidly coupling the heat recovery apparatus 150 with the stream of the refrigerant at the downstream end 117 of the evaporator 110 of the heat pump 102 as explained with reference to the hybrid heating system 100 shown in FIG. 1. In another embodiment, the method 500 includes fluidly coupling the heat recovery apparatus 150 with the stream of the refrigerant at the upstream end 127 of the evaporator 110 of the heat pump 102 as explained with reference to the hybrid heating system 300 shown in FIG. 4. In yet another embodiment, the method 500 includes fluidly coupling the heat recovery apparatus 150 with the stream of the refrigerant in parallel to the evaporator 110 of the heat pump 102 as explained with reference to the hybrid heating system 400 shown in FIG. 5.

INDUSTRIAL APPLICABILITY

The present disclosure relates to the hybrid heating systems 100, 300, and 400 having the heat pump 102 and the furnace 104 fluidly connected to each other. The hybrid heating systems 100, 300, and 400 include the heat recovery apparatus 150 for recovering heat from the flue gas discharged from the furnace 104 and transferring the recovered heat to the stream of the refrigerant in the heat pump 102. In the hybrid heating systems 100, 300, and 400, the furnace 104 will start burning the gas fuel when the outside air temperature falls too low and the heat pump 102 alone may not meet the desired heating load within the closed space 106. The furnace 104 will run at the same time as the heat pump 102 to provide the remaining balance of the desired heating load. During the heating mode and the defrosting mode, the heat recovery apparatus 150 is also operated along with the heat pump 102 to recover the heat escaping from flue gas and exchange the heat energy with the stream of the refrigerant in the heat pump 102.

The heat recovery apparatus 150 of the present disclosure may be implemented with a hybrid heating system having a high efficiency furnace. The high efficiency furnace may be defined as the furnace where 90-95% of the gas fuel is burned to heat the air. The flue gas that is generally exhausted to the atmosphere from the high efficiency furnace has temperature of about 100° F.-120° F. The heat recovery apparatus 150 having one foot length may recover heat for about 130 W when used with the high efficiency furnace. In an example, volume of air flowing through the high efficiency furnace may be considered as 10 CFM for calculation purpose. Further, the heat recovery apparatus 150 may be implemented with a hybrid heating system having a mid-efficiency furnace. The mid-efficiency furnace may be defined as the furnace where 80-90% of the gas fuel is burned to heat the air. The flue gas that is generally exhausted to the atmosphere from the mid-efficiency furnace has temperature of about 275° F. The heat recovery apparatus 150 having one foot length may recover heat for about 650 W when used with the mid-efficiency furnace. In an example, volume of air flowing through the mid-efficiency furnace may be considered as 10 CFM for calculation purpose. If the length 'L' of the heat recovery apparatus 150 is increased to more than one foot, then additional heat energy may be recovered by the heat recovery apparatus 150.

The pressure drop calculated to discharge the flue gas through the one-foot shell 202 of the heat recovery apparatus 150 is about 0.05 inch of water column, hence the power consumed by an induced draft fan may be small compared to the heat energy recovered. The induced draft fan may be located upstream or downstream of the flue gas duct 148 to discharge the flue gas from the combustion chamber 140 to the atmosphere.

In the hybrid heating system 100, during the cooling mode, the first isolation valve 230A and the second isolation valve 230B may put the heat recovery apparatus 150 in operation with the heat pump 102, such that the heat recovery apparatus 150 may act as a reservoir to store condensed refrigerant. In some embodiments, the first isolation valve 230A, the second isolation valve 230B, or both may be opened at the same time while the third isolation valve 230C is in open condition. In the hybrid heating systems 100 and 300, during the cooling mode, the first isolation valve 230A and the second isolation valve 230B may isolate the heat recovery apparatus 150 from the heat pump 102 thereby flow of the refrigerant to the heat recovery apparatus 150 is prevented and thus eliminate refrigerant flow pressure loss.

In the hybrid heating system 300, when the outside air temperature falls too low, that means during low load condition on the outdoor heat exchanger 110, the refrigerant pressure and temperature inside the outdoor heat exchanger 110 may drop as the refrigerant is sucked back to the compressor 116, which causes water freezing on the outdoor heat exchanger 110. Particularly, when the refrigerant inside the outdoor heat exchanger 110 is not able to absorb enough heat energy from the outside air flowing over the outdoor heat exchanger 110 (i.e., low load condition) and accompanied by drop in refrigerant pressure as it is sucked by the compressor 116, the refrigerant temperature inside the outdoor heat exchanger 110 may fall below water freezing temperature, which causes moisture from outside ambient air to freeze or frost on the outdoor heat exchanger 110. Therefore, the heat pump 102 is operated in the defrosting mode as explained in FIG. 3 to defrost the outdoor heat exchanger 110. In the hybrid heating systems 100 and 300, the heat recovery apparatus 150 will have the energy-gain as the heat recovery apparatus 150 exchange energy with the flue gas. The flue gas load on the heat recovery apparatus 150 may prevent or delay the drop of refrigerant pressure and temperature inside the outdoor heat exchanger 110 and thus help to delay the freezing of the outdoor heat exchanger 110.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. An apparatus for recovering heat from flue gas discharged from a furnace of a hybrid heating system, the apparatus comprising:

a shell disposed in fluid communication with the furnace and configured to allow the flue gas to flow therethrough in a first direction; and one or more tubes disposed in fluid contact with the shell and fluidly communicated with a heat pump of the hybrid heating system, wherein the heat pump is in fluid contact with the furnace, the one or more tubes configured to allow a stream of refrigerant to flow therethrough in a second direction, wherein the second direction of the flow of the stream of refrigerant is different from the first direction of the flow of the flue gas;

wherein the apparatus is fluidly coupled with the stream of refrigerant in parallel to an evaporator of the heat pump.

2. The apparatus of claim 1, wherein the shell comprises an inlet port fluidly coupled with a flue gas duct of the furnace, the inlet port configured to receive the flue gas and an outlet port configured to exit the flue gas, and wherein the flue gas flows from the inlet port to the outlet port in the first direction.

3. The apparatus of claim 1, wherein the one or more tubes are disposed along a length of the shell and comprise an inlet end and an outlet end together configured to fluidly couple with a stream of refrigerant in the heat pump, and wherein the refrigerant flows from the inlet end to the outlet end in the second direction.

4. The apparatus of claim h further comprising:

a container disposed proximate a bottom end of the shell configured to collect condensate therefrom.

5. The apparatus of claim 1, further comprising:

an inlet conduit and an outlet conduit configured to fluidly communicate with the inlet end and the outlet end, respectively, of the one or more tubes.

6. The apparatus of claim 5, further comprising:

one or more valves disposed in at least one of the inlet conduit and the outlet conduit and configured to regulate access between the apparatus and the heat pump during a heating mode based on one or more operating parameters of the hybrid heating system.

7. A hybrid heating system comprising a heat pump and a furnace, the hybrid heating system comprising:

a heat recovery apparatus in fluid communication with the heat pump and the furnace, the heat recovery apparatus configured to (i) recover heat from flue gas discharged from the furnace, and (ii) transfer the recovered heat to a stream of refrigerant in the heat pump, the heat recovery apparatus comprising:

a shell disposed in fluid communication with the furnace and configured to allow the flue gas to flow therethrough in a first direction; and one or more tubes disposed in fluid communication with the shell and the heat pump, the one or more tubes configured to allow a stream of refrigerant to flow therethrough in a second direction, wherein the second direction of the flow of stream of refrigerant is different from the first direction of the flow of the flue gas;

wherein the heat recovery apparatus is fluidly coupled with the stream of refrigerant in parallel to an evaporator of the heat pump;

one or more valves configured to regulate access between the heat recovery apparatus and the stream of refrigerant in the heat pump; and a control unit in communication with the one or more valves and configured to regulate access between the heat recovery apparatus and the heat pump during a heating mode based on one or more operating parameters of the hybrid heating system.

8. The hybrid heating system of claim 7, further comprising:

one or more sensing devices configured to communicate inputs indicative of the one or more operating parameters of the hybrid heating system with the control unit.

9. The hybrid heating system of claim 7, wherein the heat recovery apparatus is fluidly coupled with the stream of refrigerant in series with an evaporator of the heat pump.

10. The hybrid heating system of claim 9, wherein the heat recovery apparatus is fluidly coupled with the stream of refrigerant at a downstream end of the evaporator of the heat pump.

11. The hybrid heating system of claim 9, wherein the heat recovery apparatus is fluidly coupled with the stream of refrigerant at an upstream end of the evaporator of the heat pump.

12. The hybrid heating system of claim 7, wherein an inlet end and an outlet end of the one or more tubes of the heat recovery apparatus are fluidly coupled with an upstream end and a downstream end, respectively, of the evaporator of the heat pump.

13. The hybrid heating system of claim 7, wherein the heat recovery apparatus is configured to supply refrigerant to the stream of the refrigerant in the heat pump during a defrosting mode and a heating mode of the hybrid heating system.

14. A method of increasing energy efficiency of a hybrid heating system during a heating mode, the hybrid heating system comprising a heat pump and a furnace, the method comprising:

contacting a heat recovery apparatus with a stream of flue gas discharged from the furnace and a stream of refrigerant in the heat pump, wherein the heat recovery apparatus comprises a shell and one or more tubes disposed in contact with the shell;

fluidly coupling the heat recovery apparatus with the stream of refrigerant in parallel to an evaporator of the heat pump;

directing the flue gas to flow through the shell in a first direction;

directing the stream of refrigerant to flow through the one or more tubes in a second direction, wherein the one or more tubes are fluidly communicated with a stream of refrigerant in the heat pump, and wherein the second direction of the flow of the stream of refrigerant is different from the first direction of the flow of the flue gas; and introducing, via the heat recovery apparatus, a stream of refrigerant to the stream of refrigerant in the heat pump during the heating mode and a defrosting mode.

15. The method of claim 14, further comprising:

regulating access between the heat recovery apparatus and the heat pump during the heating mode via a control system and one or more valves, based on one or more operating parameters of the hybrid heating system.

16. The method of claim 14, further comprising:

fluidly coupling the heat recovery apparatus with the stream of refrigerant in series with an evaporator of the heat pump.

17. The method of claim 16, further comprising:

fluidly coupling the heat recovery apparatus with the stream of refrigerant at a downstream end of the evaporator of the heat pump.

18. The method of claim 16, further comprising: fluidly coupling the heat recovery apparatus with the stream of refrigerant at an upstream end of the evaporator of the heat pump.

* * * * *